US009144322B2

(12) United States Patent
Gillam

(10) Patent No.: US 9,144,322 B2
(45) Date of Patent: Sep. 29, 2015

(54) SYSTEMS AND METHODS FOR INFANT STABILIZATION

(71) Applicant: Infant Guard LLC, Austin, TX (US)

(72) Inventor: Andrew Gillam, Austin, TX (US)

(73) Assignee: Infant Guard LLC, Austin, TX (US)

( * ) Notice: Subject to any disclaimer, the term of this patent is extended or adjusted under 35 U.S.C. 154(b) by 0 days.

(21) Appl. No.: 14/481,597

(22) Filed: Sep. 9, 2014

(65) Prior Publication Data

US 2015/0157139 A1 Jun. 11, 2015

Related U.S. Application Data

(60) Provisional application No. 61/914,935, filed on Dec. 11, 2013.

(51) Int. Cl.
*A47D 13/02* (2006.01)
*A47D 9/00* (2006.01)

(52) U.S. Cl.
CPC . *A47D 13/02* (2013.01); *A47D 9/00* (2013.01)

(58) Field of Classification Search
CPC ..... A47D 13/02
USPC ..... 224/158, 159, 665, 901.8, 666
See application file for complete search history.

(56) References Cited

U.S. PATENT DOCUMENTS

| | | | | |
|---|---|---|---|---|
| 2,625,192 | A * | 1/1953 | Kinskie | 224/665 |
| 2,628,358 | A * | 2/1953 | Neils | 2/69.5 |
| 4,320,863 | A * | 3/1982 | Lyer et al. | 224/259 |
| 4,414,692 | A * | 11/1983 | Dzierson et al. | 2/160 |
| 4,676,419 | A * | 6/1987 | Victor | 224/649 |
| 5,224,637 | A * | 7/1993 | Colombo | 224/159 |
| 5,412,545 | A * | 5/1995 | Rising | 362/105 |
| 5,413,262 | A * | 5/1995 | Dewire et al. | 224/675 |
| 5,871,132 | A * | 2/1999 | Hargreaves | 224/576 |
| 6,213,362 | B1 * | 4/2001 | Lorenzini et al. | 224/158 |
| 6,431,420 | B1 * | 8/2002 | Cragg | 224/223 |
| 6,824,031 | B2 * | 11/2004 | McKenzie | 224/666 |
| 6,837,406 | B2 * | 1/2005 | Sclafani | 224/159 |
| 6,913,176 | B1 * | 7/2005 | Buscemi | 224/665 |
| 6,926,181 | B1 * | 8/2005 | Vath | 224/159 |
| 7,165,706 | B2 * | 1/2007 | Barr | 224/661 |
| 7,320,421 | B2 * | 1/2008 | Guminski | 224/268 |
| 7,810,682 | B2 * | 10/2010 | Balensiefer et al. | 224/158 |
| 7,841,653 | B2 * | 11/2010 | Sanchez | 297/183.3 |
| 8,453,894 | B2 * | 6/2013 | Jung et al. | 224/160 |
| 8,464,919 | B1 * | 6/2013 | Goozdich | 224/159 |
| 8,505,789 | B2 * | 8/2013 | Green | 224/158 |
| 2005/0145663 | A1 * | 7/2005 | Samuels | 224/575 |
| 2006/0097019 | A1 * | 5/2006 | Just-Buddy | 224/148.7 |
| 2007/0029356 | A1 * | 2/2007 | Moriguchi et al. | 224/160 |
| 2008/0217368 | A1 * | 9/2008 | Denton | 224/159 |
| 2008/0245830 | A1 * | 10/2008 | Pfeiffer | 224/159 |
| 2010/0051658 | A1 * | 3/2010 | Parness | 224/158 |
| 2010/0187268 | A1 * | 7/2010 | Rosen et al. | 224/158 |

* cited by examiner

*Primary Examiner* — Justin Larson
(74) *Attorney, Agent, or Firm* — Pierson IP, PLLC

(57) ABSTRACT

Embodiments disclose a secondary, supplemental, extra, etc. support system to help a parent secure an infant to the parent, wherein the supplemental support system is designed for comfort and flexibility. While a plurality of potential hazardous situations may arise while a parent is holding an infant, such as dropping, choking, circulation impairment etc., embodiments may limit, reduce, or eliminate the hazards and injuries to the infant and/or parent.

7 Claims, 5 Drawing Sheets

SYSTEMS AND METHODS FOR INFANT STABILIZATION

CROSS-REFERENCE TO RELATED APPLICATIONS

This application claims a benefit of priority under 35 U.S.C. §119 to Provisional Application No. 61/914,935 filed on Dec. 11, 2013, which is fully incorporated herein by reference in its entirety.

BACKGROUND INFORMATION

1. Field of the Disclosure

Examples of the present disclosure are related to systems and methods to secure an infant to a parent. More particularly, embodiments relate to coupling an article of clothing configured to be worn by the parent with a basinet.

2. Background

Studies in obstetrics and pediatrics have raised initiatives to maximize time spent between parents and their newborn infants. The initiatives desire that the parents spend time with their infant immediately following birth to facilitate maternal, breast feeding, and other activities. Particularly, the initiatives advocate the rapid bonding of mothers and their infant, which will minimize a timing window for introducing the infant to antibodies and nutritional benefits derived from maternal, breast feeding.

Health care facilities, such as hospitals, generally demonstrate support for such initiatives by rapidly pairing infants with their mothers following delivery, and by allowing infants to stay with their parents in their hospital room for prolonged periods after birth. Conventionally, the pairing occurs by co-locating an infant and mother in the mother's hospital room, which includes a bed or comparable device, such as a chair.

However, parental fatigue following a child birth is prevalent for the parents. Parental fatigue may occur due to the parents of an infant having to stay awake for long, consecutive time periods during child birth. Additionally, parental fatigue may occur due to the stressful nature of child birth.

Combining the health initiatives with parental fatigue may lead to circumstances where a parent needs secondary support mechanisms to ensure infants are not dropped, released, etc. while the parent is holding the infant. For example, during maternal, breast feeding, a mother may need a secondary support system immediately following a long and stressful birth of the infant. Furthermore, secondary support mechanisms may be desired during any activity that may require the parent to hold the infant, such as holding the infant while walking, feeding the infant, etc.

Accordingly, needs exist for more effective and efficient methods and systems for secondary, supplemental support systems to secure an infant to a parent.

SUMMARY

Embodiments of this disclosure may be configured to be a secondary, supplemental, extra, etc. support system to help a parent secure an infant to the parent, wherein the supplemental support system is designed for comfort and flexibility. While a plurality of potential hazardous situations may arise while a parent is holding an infant, such as dropping, choking, circulation impairment etc., embodiments may limit, reduce, or eliminate the hazards and injuries to the infant and/or parent.

Embodiments disclosed herein describe systems and methods including a bassinet and an adult article of clothing configured to be worn by a parent.

The bassinet may be any container configured to hold an infant, wherein the bassinet may include at least one first coupling interface. The adult article of clothing may be a vest, belt, strap, sash, etc. with a second coupling interface, wherein the first coupling interface is configured to couple with the second coupling interface.

Embodiments may provide a flexible yet robust solution to circumvent scenarios leading to an accidental drop of an infant by fatigued parents, or parents distracted for any number of reason. Embodiments may be used in hospital settings to limit, reduce, or eliminate the risk of serious injury to an infant, while also limiting, reducing, or eliminating the potential emotional trauma to a parent of a newborn infant due to drop incidents.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
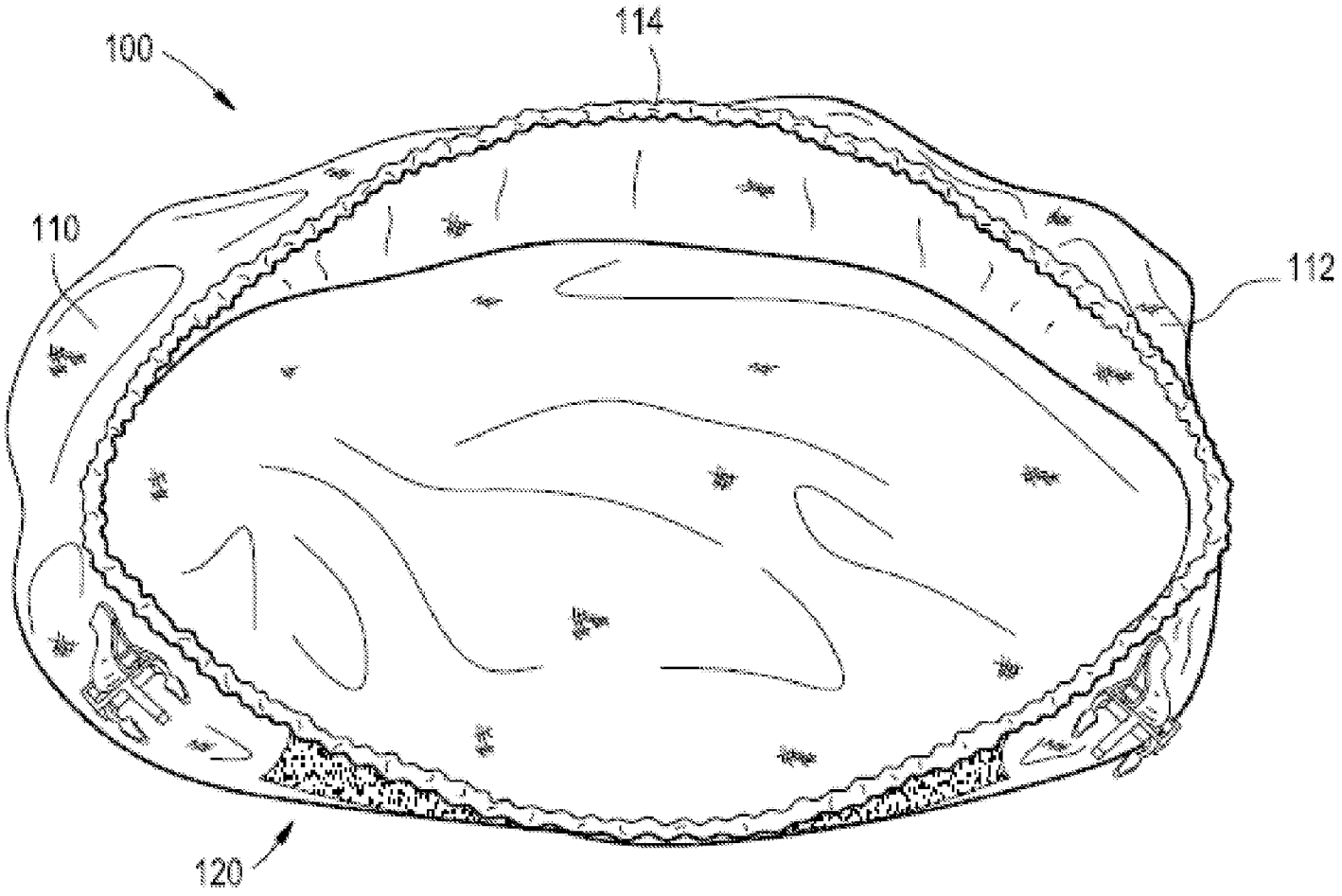
FIG. 1 depicts one embodiment of a portion of support system to secure an infant to an adult.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

FIG. 1 depicts one embodiment of a portion of support system 100 to secure an infant to an adult. Support system 100 may include a bassinet 110 and infant coupling members 120.

Bassinet 110 may be comprised of any type of fabric or a plurality of different types of fabric including cotton, wool, nylon, acrylic, etc., and may be manufactured in a variety of styles. Bassinet 110 may be cradle, bed, enclosure, etc. configured to hold an infant. In further embodiments, bassinet 110 may be a garment configured to be positioned on an infant's upper body and/or lower body. For example, infant article of clothing 110 may be a shirt, jumpsuit, onesie, jacket, sweater, etc. Infant article of clothing 110 may be configured to be worn by the infant for protection and warmth.

Bassinet 110 may include a plurality of sidewalls 112 with an opening 114. In embodiments, sidewalls 112 may be configured such that opening 114 may be a permanent opening, wherein sidewalls 112 do not fold over themselves. Accordingly, an infant positioned within the bassinet 110 may not be fully covered by sidewalls 112 via opening 114. Furthermore, a circumference of opening 114 may be comprised of a semi-rigid, semi-flexible polymer that may be expanded and contracted.

Figure 2:
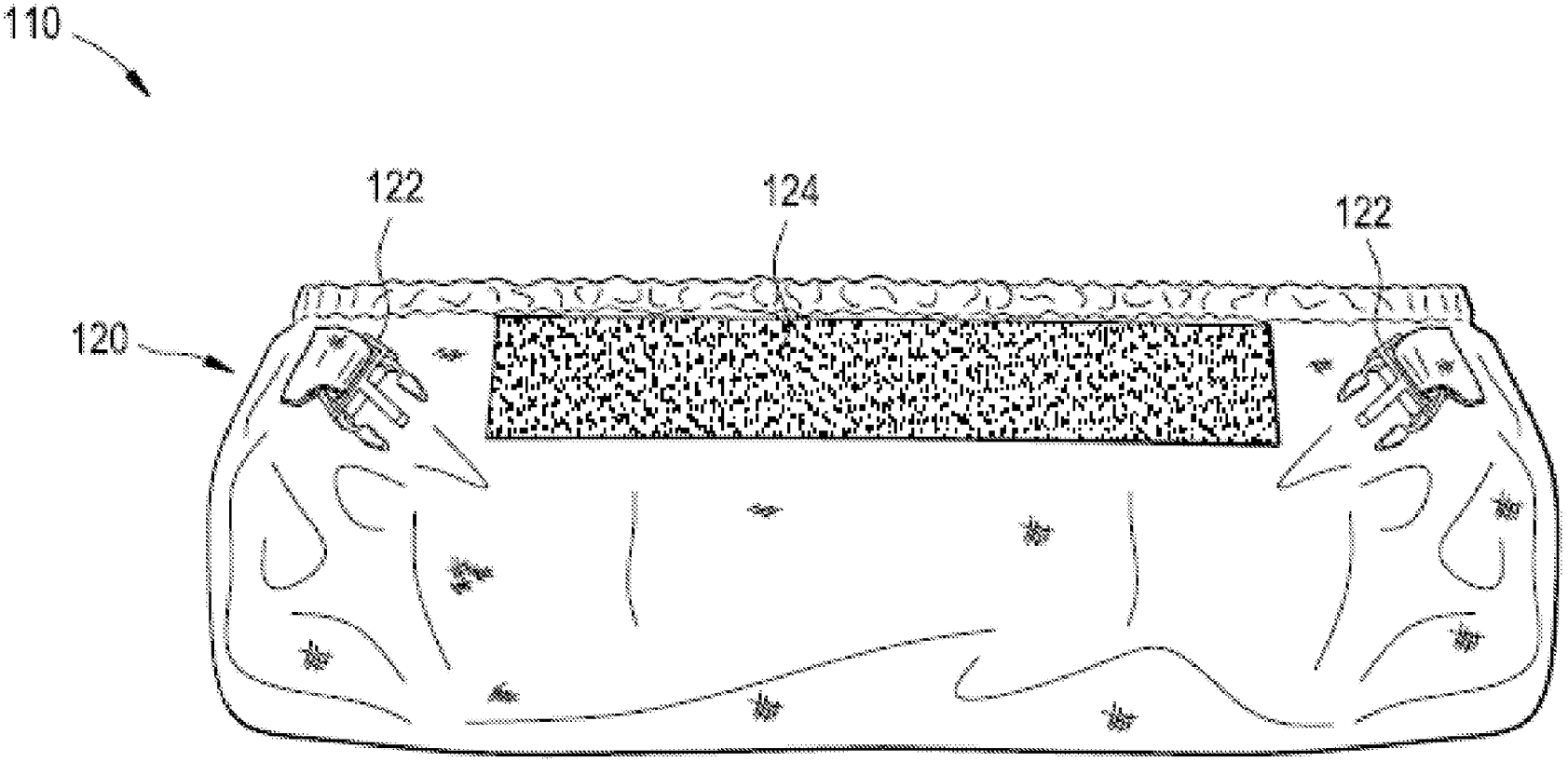
FIG. 2 depicts one embodiment of a portion of support system to secure an infant to an adult.

FIG. 2 depicts one embodiment of infant coupling interface 120 positioned on a sidewall 112 of bassinet 110. Infant coupling interface 120 may be permanently positioned on a front and outer surface of bassinet 110, such that infant coupling interface 120 may be positioned on a sidewall 112. However, one skilled in the art will appreciate that infant coupling interface 120 may be positioned at any location on an outer surface of bassinet 110. For example, infant coupling interface 120 may be configured to be positioned to extend vertically across a sidewall 112, extend horizontally across a sidewall 112, extend diagonally across a sidewall 112, etc.

The positioning of infant coupling interface 120 on bassinet 110 may vary to provide coupling support to the infant from the parent based on the activity the parent is engaging in.

Figure 3:
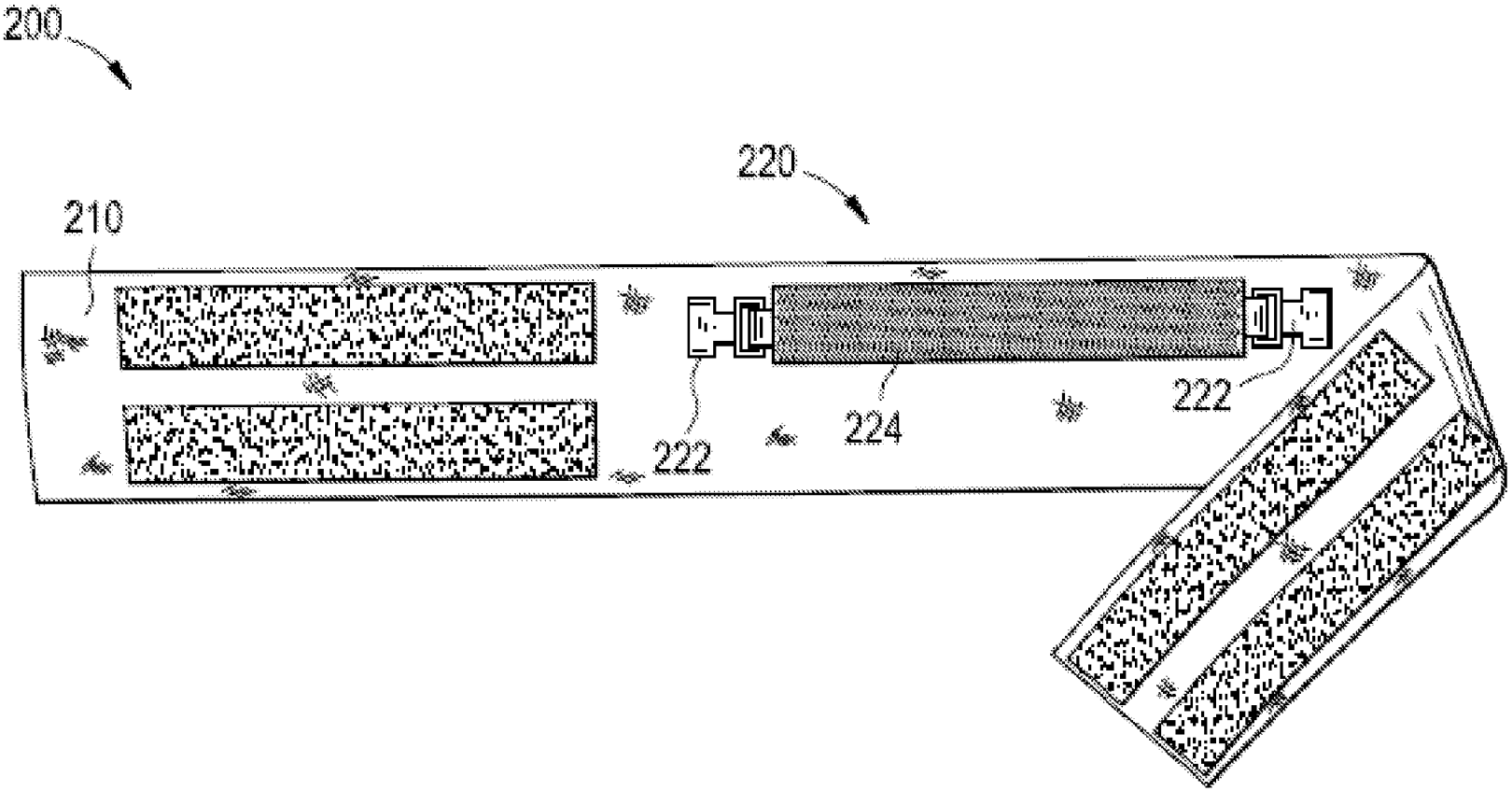
FIG. 3 depicts one embodiment of a portion of support system to secure an infant to an adult.

Infant coupling interface 120 may also be configured to be removably coupled with an adult article of clothing, shown in FIG. 3. In embodiments, infant coupling interface 120 may include first infant coupling members 122, and second infant coupling member 124. First infant coupling members 122 may be a male type coupling interface, such as male portions of fasteners, snaps, buckle, buttons, clips, etc. Second infant coupling member 124 may be a second type of coupling interface, which is a different coupling member that first coupling member 122. Second infant coupling member 124 may be configured to be positioned in-between the first infant coupling members. In embodiments, second infant coupling member 124 may include snaps, a hoop and lock mechanism such as Velcro, a zipper, button(s), buckle(s), clip(s), etc.

FIG. 3 depicts one embodiment of a portion of support system 200 to secure an infant to an adult. Coupling system 200 may include an adult article of clothing 210 and adult coupling interface 220.

Adult article of clothing 210 may be comprised of any type of fabric or a plurality of different types of fabric including cotton, leather, cloth, etc., and may be manufactured in a variety of styles. Adult article of clothing 210 may be an adjustable belt-like device, such as a belt, sash, scarf, etc. that may be configured to fasten securely, yet comfortably around a parent's body, such as around the parent's midsection, waist, or any other portion of the parent's body where article of clothing 210 fastens comfortably, yet securely to the parent. Adult article of clothing may be configured to fasten around a parent's mid-section, and may be secured using hook and loop fasteners.

Disposed on at least a portion of outer surface of adult article of clothing 210 may be adult coupling interface 220. In embodiments, adult coupling interface 220 may be positioned on an entire outer surface of adult article of clothing 210, or on only a front portion of adult article of clothing 210. In embodiments, adult coupling interface 220 may be fixedly or removably attached to the outer surface of adult article of clothing 210, such that an adult may wear adult article of clothing as a conventional belt, sash, strap, etc.

Adult coupling interface 220 may include first adult coupling members 222, and second adult coupling member 124. First adult coupling members 222 may be a female type coupling interface, such as female portions of fasteners, snaps, buckle, buttons, clips, etc. In embodiments, first adult coupling members 222 may be configured to align with and couple with first infant coupling members 122, such that first adult coupling members 222 and first infant coupling members 122 may be removably connected with one another. Second adult coupling member 324 may be a second type of coupling interface, which is a different coupling member that first adult coupling member 222. Second adult coupling member 224 may be configured to be positioned in-between the first adult coupling members 222. In embodiments, second adult coupling member 224 may include snaps, a hoop and lock mechanism such as Velcro, a zipper, button(s), buckle(s), clip(s), etc. In embodiments, second adult coupling member 224 may be configured to align with and couple with second infant coupling members 124, such that second adult coupling members 224 and second infant coupling members 124 may be removably connected with one another. Accordingly, adult article of clothing 210 may couple with bassinet 110 via different coupling devices and systems, which may provide extra support while an infant is positioned within bassinet 110.

Figure 4:
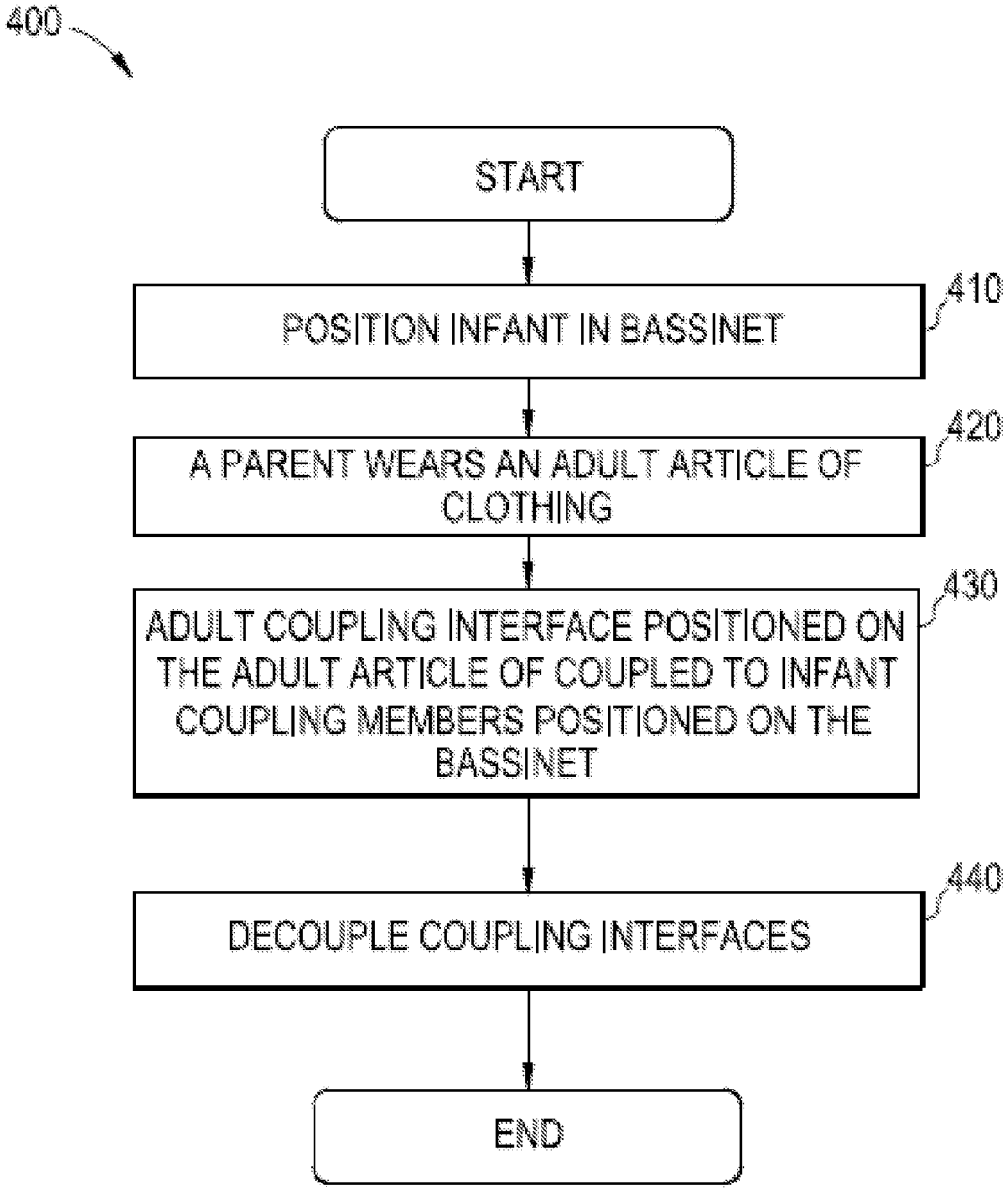
FIG. 4 depicts one embodiment of a method for a secondary, stabilization system to secure infants to adults.

FIG. 4 illustrates a method 400 for a secondary, stabilization system to secure infants to adults. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

At operation 410, an infant may be positioned within a bassinet. Operation 410 may include an infant article of clothing that is the same as or similar to bassinet 110, in accordance with one or more implementations.

At operation 420, a parent may wear an adult article of clothing. The parent may wear the adult article of clothing by adjusting the adult article of clothing to be secured tightly around a portion of an adult's body. In embodiments, the adult article of clothing may be adjusted to be positioned adjacent to the parent's midsection, such that the adult article of clothing is secured to the parent. Operation 420 may include an adult article of clothing that is the same as or similar to adult article of clothing 210, in accordance with one or more implementations.

At operation 430, adult coupling interface positioned on the adult article of clothing may be removably coupled to an infant coupling interface positioned on clothing surface of the bassinet. The adult coupling interface may include adult coupling members, which may include a male or female component, to couple with infant coupling member including infant coupling members, wherein the infant coupling members may include corresponding male or female components.

In embodiments, when the adult coupling interface may be coupled with the infant coupling interface, an infant may be securely coupled to the parent in a position adjacent to the parent while the infant is raised off a ground surface. Accordingly, the infant may be positioned adjacent to the parent's mid-section while the parent positions one hand underneath the bassinet. Accordingly, the parent may have a second free hand. The coupling of the coupling members may secure the infant to the parent for a period of time, which may be any desired period of time. For example, in embodiments, the period of time may be a temporary period of time lasting from a couple of seconds, to a couple of minutes, or when the adult performs actions to apply enough force to decouple the coupling members.

Accordingly, the coupling members may be configure to act as a secondary support to couple an infant to a parent when the infant is raised off a floor surface to protect against an accidental drop of the infant, but the coupling members may not apply force to independently maintain the infant in an elevated state without support from the parent. Operation 430 may include infant coupling members and adult coupling members that are the same as or similar to infant coupling interface 120 and adult coupling interface 220, in accordance with one or more implementations.

At operation 440, the infant may be removed from the bassinet, and then a parent may perform actions to apply enough force to decouple the infant coupling interface and adult coupling interface. Operation 440 may include an adult article of clothing that is the same as or similar to adult article of clothing 210, in accordance with one or more implementations.

Figure 5:
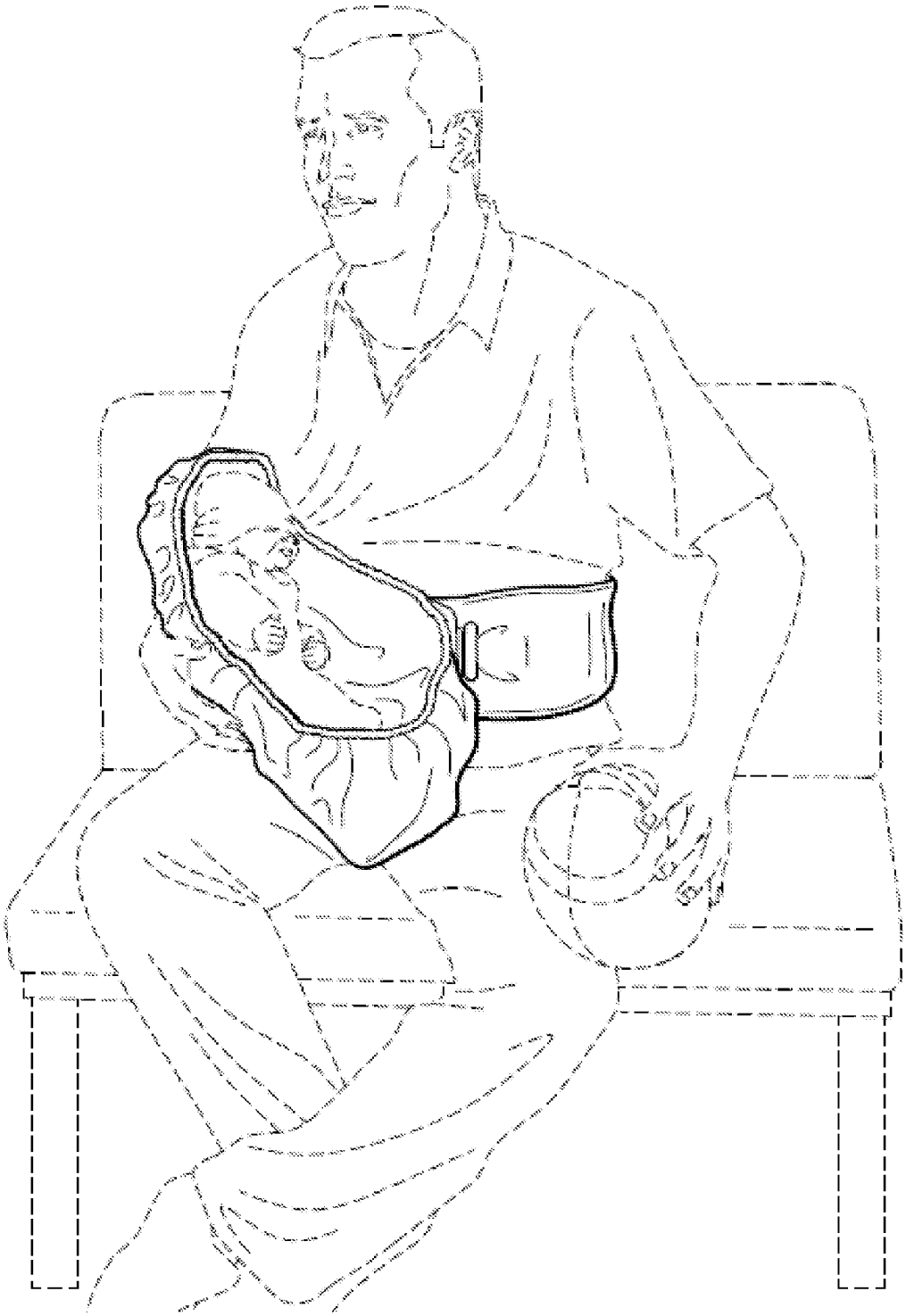
FIG. 5 depicts one embodiment of a stabilization system in use.

FIG. 5 depicts one embodiment of an infant stabilization system in use. As depicted in FIG. 5, an infant may be positioned within bassinet 110 and an adult may be wearing adult article of clothing 210, wherein bassinet 110 is coupled to adult article of clothing 210. Furthermore, the adult may be providing additional support to secure the infant within bassinet 110.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The flowcharts and block diagrams in the flow diagrams illustrate the architecture, functionality, and operation of possible implementations of systems, methods, and computer program products according to various embodiments of the present invention. In this regard, each block in the flowcharts or block diagrams may represent a module, segment, or portion of code, which comprises one or more executable instructions for implementing the specified logical function (s).

What is claimed is:

1. A support system to secure an infant to an adult, the support system comprising:

a bassinet configured to receive the infant, the bassinet including an infant coupling interface, wherein the infant coupling interface includes first infant coupling members and a second infant coupling member, the first infant coupling members being different coupling devices than the second infant coupling member;

an adult article of clothing configured to be worn by the adult, the adult article of clothing including an adult coupling interface, wherein the infant coupling interface is configured to couple with the adult coupling interface, wherein the adult coupling interface includes first adult coupling members and a second adult coupling member, the second adult coupling member being positioned between the first adult coupling members and the first adult coupling members are different coupling devices than the second adult coupling member, wherein the first adult coupling members are configured to interface with the first infant coupling members, and the second adult coupling member is configured to interface with the second infant coupling member.

2. The support system of claim 1, wherein the infant coupling interface is positioned on an outer surface of the bassinet.

3. The support system of claim 1, wherein the adult coupling interface is positioned on an outer surface of the adult article of clothing.

4. The support system of claim 1, wherein the adult article of clothing is an adjustable device configured to be worn around a midsection of the adult.

5. The support system of claim 4, wherein if the infant coupling interface is coupled with the adult coupling interface, the infant may be placed adjacent to the midsection of the adult and elevated off a floor surface.

6. The support system of claim 1, wherein the infant coupling interface is removably coupled with the adult coupling interface.

7. The support system of claim 1, wherein the adult coupling interface and the infant adult interface are configured to maintain the bassinet in an elevated position without any additional forces.

* * * * *